US005574429A

United States Patent [19]

Streeter

[11] Patent Number: 5,574,429

[45] Date of Patent: Nov. 12, 1996

[54] SELF-CONTAINED, PROGRAMMABLE NON-POSITION-SENSITIVE VIBRATION DETECTING ALARM SYSTEM

[76] Inventor: Robert W. Streeter, 2621 Palisade Ave. No. 11K, Riverdale, N.Y. 10463

[21] Appl. No.: 4,855

[22] Filed: Jan. 15, 1993

[51] Int. Cl.[6] ..... G08B 13/14

[52] U.S. Cl. ..... 340/571; 340/566; 340/568; 340/693

[58] Field of Search ..... 340/571, 566, 340/568, 693

[56] References Cited

U.S. PATENT DOCUMENTS

| | | | |
|---|---|---|---|
| 3,644,921 | 2/1972 | Duggan et al. | 340/571 |
| 3,721,956 | 3/1973 | Hamann et al. | 340/427 |
| 4,247,847 | 1/1981 | Gontowski, Jr. | 340/566 |
| 4,282,518 | 8/1981 | Bonner | 340/566 |
| 4,337,462 | 6/1982 | Lemelson | 340/572 |
| 4,358,750 | 11/1982 | Webster | 340/429 |
| 4,381,504 | 4/1983 | Bitko | 340/689 |
| 4,845,464 | 7/1989 | Drori et al. | 340/429 |
| 4,931,769 | 6/1990 | Phillips et al. | 340/541 |
| 5,153,561 | 10/1992 | Johnson | 340/571 |
| 5,254,970 | 10/1993 | Brady | 340/693 |
| 5,260,689 | 11/1993 | Meyers et al. | 340/571 |
| 5,317,304 | 5/1994 | Choi | 340/571 |

FOREIGN PATENT DOCUMENTS

| | | |
|---|---|---|
| 0305982 | 3/1989 | European Pat. Off. . |
| 2161633 | 1/1986 | United Kingdom . |
| 2237913 | 5/1991 | United Kingdom . |

*Primary Examiner*—Glen Swann
*Attorney, Agent, or Firm*—Gerow D. Brill

[57] ABSTRACT

A self contained, programmable alarm system is securely attached to an article and activates an alarm device when the article is moved. A programmable controller provides the operational routines which determine the function of the alarm system. Non-position-sensitive, vibration activated switching means are included for activating the alarm device after sensing movement of the article. The alarm system can be mounted in a water resistant enclosure that can be locked by a further switch that physically locks the enclosure to the article, electrically connects power to the alarm system, and provides access to a secure compartment within the enclosure for battery storage.

22 Claims, 4 Drawing Sheets

SELF-CONTAINED, PROGRAMMABLE NON-POSITION-SENSITIVE VIBRATION DETECTING ALARM SYSTEM

BACKGROUND

1. Field of the Invention

This invention relates to a new and improved alarm system. More particularly, the present invention relates to a portable, self-contained alarm system which would be attached to an article to monitor the movement of the article, and sound an alarm signal under certain conditions such as the unauthorized movement of the article.

2. Description of the Prior Art

Portable alarm systems have been discovered in the prior art. However, the inventor is not aware of any prior art which provides the unique combination of the present invention's features.

The following seven patents are the closest prior art of which the inventor is aware.

1. U.S. Pat. No. 5,254,970 issued to Edward T. Brady (hereafter the "Brady Patent") on Oct. 19, 1993 for "Programmable Personal Alarm"
2. U.S. Pat. No. 3,644,921 issued to Duggan et al (hereafter the "Duggan Patent") on Feb. 22, 1972 for "Alarm With Trundle Switch"
3. U.S. Pat. No. 5,153,561 issued to Eric S. Johnson (hereafter the "Johnson Patent") on Oct. 6, 1992 for "Secured Valuable Box For Beach Goers"
4. U.S. Pat. No. 5,260,689 issued to Chip E. R. Meyers et al (hereafter the "Meyers Patent") on Nov. 9, 1993 for "Dual-Mode Ski Alarm Apparatus"
5. U.S. Pat. No. 4,337,462 issued to J. Lemelson (hereafter the "Lemelson Patent") on Jun. 29, 1982 for "Theft Detection System and Method"
6. U.S. Pat. No. 4,931,769 issued to K. Phillips (hereafter the "Phillips Patent") on Jun. 5, 1990 for "Method and Apparatus for Controlling the Operation of a Security System"
7. G. B. Pat. No. 2,161,633 issued to A. Gersh (hereafter the "Gersh Patent") on Jan. 15, 1986 for "Anti theft Bicycle Alarm"

The Brady Patent discloses a personal alarm which makes use of a user programmed ROM to store a code which disarms the alarm system. This patent differs significantly from the disclosed invention because it is not an anti-theft or monitoring device and does not contain motion detection means and does not contain provisions for securely mounting the system to an article.

Furthermore, the user programmed ROM in Brady is used only to store a disarming code. The invention of the current disclosure uses a pre-programmed or user programmed ROM which varies the method of operation as well as the operating characteristics of the alarm system.

Also, the alarm system of the Brady Patent has no way of disconnecting the battery power source from the system and therefore is wasteful of battery life. This differs significantly from the disclosed patent which provides for a key switch to disconnect the power source when the alarm system is not in use.

Furthermore, the Brady Patent does not specify the means by which access is gained to the battery compartment; such access could allow immediate unauthorized deactivation of the alarm system. The currently disclosed invention specifies an electromechanical cam lock key switch as the secure means by which access is gained to the battery compartment and further incorporates this key switch as a means to disconnect the battery power source from the alarm system while also providing a means for secure attachment of the alarm system enclosure to an article.

Finally, the Brady Patent contains no provision for storing important data such as the disarming code once the power is removed from the system. Thus, important operating data must be reentered every time the battery is replaced. The alarm system of the current disclosure does not rely on such mandatory programming information because required operating information is retained in the microcontroller even when power is removed during battery replacement.

The Duggan Patent describes a burglar alarm for portable office equipment, which uses a mechanical trundle switch to complete an electrical circuit between a battery and a buzzer. This differs significantly from the invention of the current disclosure in that the Duggan Patent lacks sophisticated microcontroller circuitry, user interactive audible and visual means and non-position-sensitive motion sensor means. Thus, the Duggan Patent is severely limited by its' inability to provide varying methods and characteristics of operation.

The Duggan invention uses a key switch to secure a battery storage compartment and to mechanically reset the alarm system. Also, the Duggan alarm is attached to the office equipment by an unspecified screw plate or other fastening means. The invention of the current disclosure differs significantly from the Duggan Patent by using an electromechanical switch which not only secures a battery compartment, but also connects electrical power to the alarm system and is an integral part of a disclosed means by which the system enclosure is securely attached to an article.

The Johnson Patent discloses a secured valuable box for beach goers. It differs from the disclosed invention in that it does not provide anti-theft capabilities except for the alarm system box and its' contents. Furthermore, the Johnson alarm is continuously powered by a solar cell which is appropriate only for its' intended daytime beach use. It would be inappropriate as an anti-theft device used primarily at night.

The alarm system of the current disclosure differs from the Johnson Patent by being adaptable to securely mount to many types of articles and by providing a key switch to disconnect the battery power source from the alarm system and therefore extend battery life when the alarm system is not in use. Further, this electromechanical cam lock key switch provides a means to achieve the secure alarm system mounting disclosed in the present invention.

Also, the Johnson Patent contains discrete electronic circuits which sequentially perform the functions of arming, disarming, and resetting, and which can vary the alarm duration and motion sensitivity. The invention of the current disclosure differs from the Johnson Patent because it uses a microcontroller unit as a means to dynamically perform such functions and change operating characteristics of the alarm system. Furthermore, the disclosed invention differs from the Johnson Patent because it can be both pre-programmed or user programmed to vary in method of operation and operating characteristics and has a virtually unlimited dynamic programming capability.

The Meyers Patent discloses an anti-theft ski alarm. This patent differs from the currently disclosed invention in that the alarm system in the Meyers Patent is neither pre-programmed or user programmed but rather contains discrete circuitry to provide a singular method of operation and system characteristics.

Furthermore, the alarm system of the Meyers Patent is attached to the ski with adhesive or exposed screws and does not provide for a secure battery compartment. Adhesive means of attachment is especially undesirable because it prevents transfer of the alarm from the alarmed article if such removal is required due to wear, damage or replacement of the article. Therefore, the invention of the current disclosure differs from the Johnson invention by disclosing secure mounting means, secure battery compartment means and a means for providing electrical power to the system; such means being a single cam lock key switch.

The Meyers Patent discloses a visual alarm means to indicate that the alarm system is powered. The invention of the current disclosure differs significantly from the Meyers Patent in that the visual display device disclosed provides a means by which the user can interact with the alarm system microcontroller unit to vary the method of system operation and the system operating characteristics. Furthermore, the visual display device of the current invention can provide other indications such as low battery or armed status indication.

The Lemelson Patent discloses a theft detection system and method that involves the short wave transmission of code signals which are indicative of the identity of the article. While the Lemelson Patent also includes a local alarm signal as part of the system, the currently disclosed invention differs significantly from the Lemelson Patent.

The Lemelson invention involves the use of many expensive components to provide a sophisticated detection means. For example, expensive accelerometers are mounted in each of three axis and are connected to analog to digital converters and a computer in order to provide accurate information as to exact distance of movement in each of the three axis. The currently disclosed invention uses multiple switch means which are non-position-sensitive and are connected to a microcontroller unit. These components are inexpensive and provide sufficient capability to provide an alarm condition when the article is moved.

Furthermore, the alarm system of the current disclosure can be user programmed or pre-programmed to vary the method and characteristics of operation. The alarm system of the Lemelson Patent cannot vary in either method or characteristics of operation and must be pre-programmed to contain the parameters which define an alarm condition.

In addition, the Lemelson Patent lacks the user programming switches and visual display and audible devices disclosed in the current invention. Also, the Lemelson Patent discloses unspecified mounting means of the motion detection means only, and does not provide for a power source which is secure from unauthorized removal. The invention of the current disclosure specifies a secure battery compartment and mounting means of the entire alarm system which makes use of a single electromechanical cam lock key switch.

The Phillips Patent discloses a method and apparatus for controlling the operation of a security system. The invention is basically a sophisticated means for programming a deactivation code and controlling a set of alternative options for a zone type intrusion or fire security system.

The Phillips Patent differs significantly from the disclosed invention because it does not contain motion detection means, an alarm means, an audible device for prompting the user, a secure mounting means, a power means and a means for secure storage of said power means or a means to connect power to the system. Furthermore, the electronic circuitry in the Phillips Patent requires external wiring and power that is unspecified and may not be self-contained and would differ from the invention currently disclosed because the alarm system could not be portable.

Finally, the invention of the current disclosure differs from the Phillips Patent because the Phillips Patent discloses a means by which only the method of alarm system operation is controlled. The invention of the current disclosure contains a means by which the method of operation as well as the operating characteristics of the alarm system may be controlled.

The Gersh Patent discloses an anti theft bicycle alarm. While the Gersh Patent discloses a singular means to securely mount the alarm system, provide a secure battery compartment and provide a means to connect power to the alarm system, the Gersh Patent does not provide many important features which are disclosed in the current invention.

For example, the Gersh Patent does not contain a non-position motion detection device and therefore the Gersh invention may not operate properly if the article which is being monitored is at rest in many possible positions. Also, the Gersh Patent discloses a low-decibel alarm signal rather than the high decibel piezoelectric alarm disclosed in the current invention. Furthermore, the Gersh Patent discloses secure mounting on cylindrical articles only. The current invention discloses a secure mounting means capable of mounting to multiple types of surfaces. Specifically, a flat mounting bracket is disclosed which will securely mount the alarm system to flat articles. Also, the unique sliding channels disclosed will allow for brackets which will mount the alarm system to an unlimited variety of different types of articles.

Finally, the alarm system of the current disclosure can be user or pre-programmed to vary in method of operation and operating characteristics and includes a microcontroller unit to control the alarm system, and programming switches and audible and visual display devices which interface the alarm system user with the microcontroller unit. The Gersh Patent is restricted to a singular method and characteristics of operation which are predetermined by the selection of the time delay mechanism and electronic circuit counter used in the alarm system.

While these various inventions in the prior art have endeavored to provide suitable portable alarm systems, or components there of, which are appropriate monitoring devices for the objects for which they are designed, none of the portable alarm systems of the prior art provide the flexibility in controlling the method of operation and characteristics of operation of the alarm system as well as incorporating components and means as hereinafter described for the present invention.

It is therefore an object of the current invention to provide a portable alarm system that has pre-programmed or user programmed or both method of operation and characteristics of operation. This type of alarm system will provide flexibility of use and proper operation for a variety of system users and alarm system environments. Furthermore, this type of portable alarm system will prevent many operational inadequacies which occur in systems of the prior art.

It is another objective of the current invention to provide a portable alarm system with optional audible and visual means and user programming switches by which the alarm system control means can be interfaced with the alarm system user.

It is another objective of the current invention to provide a portable alarm system that uses a single means to connect power to the system, secure a compartment for said means from unauthorized access, and provide a means to secure the alarm system and its enclosure to an article which is to be monitored.

A still further objective of the current invention is to provide a mounting means for a portable alarm system that does not use exposed screws, adhesive or any other components that may be easily defeated. It is important to note that even "tamper-resistant" screws which are exposed must still use a screwdriver which once provided to alarm system users becomes available to anyone to obtain and use.

Yet another objective of the currently disclosed invention is to provide a portable alarm system that uses a motion detection means which will function properly regardless of the initial orientation of the alarm system, as well as provide equal monitoring sensitivity regardless of the plane(s) of motion.

These and other objectives and advantages of the present invention will be apparent to those skilled in the art from the following specifications, claims and appended drawings.

SUMMARY

A self contained, programmable, non-position-sensitive vibration activated alarm system is disclosed. One embodiment of the alarm system is comprised of a programmable controller unit, optional user-programming switch(es), optional visual display device(s) or audio output device, an electromechanical cam lock keyswitch, one or more non-position-sensitive vibration activated devices, an oscillator circuit, a piezo-electric alarm and a battery power source, all self contained in a rugged, watertight, securely attachable enclosure.

The controller unit runs the operating program for the alarm system. The operating program determines the operation of the alarm system. This program may allow user programming of many parameters such as arming and disarming delay time, arming time countdown notification, quantity of vibrations within a specified period of time to create an alarm condition, armed alert indication, alarm sound characteristics, low battery alert, and minimum and maximum alarm times. These types of parameters may be set using user programming switch(es) while viewing the visual display device(s) or listening to the audio output device. Values for the variables within the operating program may also be pre-programmed into the controller unit by use of a pre-programmable from device.

The one or more non-position-sensitive, vibration activated devices are electrically open when they are at rest in any positional orientation. The devices output a series of switch pulses to the controller unit whenever they are vibrated, shocked, moved or tilted. The controller unit evaluates these pulses, and if they meet the user programmed or pre-programmed alarm criteria, the piezo-electric alarm is sounded.

A standard 9 volt battery may be used as a power source for the alarm system, and it is securely locked in a battery compartment in the alarm enclosure through the use of a cam lock keyswitch. The security of this keylock switch may be enhanced when the mating key is non-copiable and has a large variety of different key combinations. This keyswitch is also used to electrically connect the power source to the alarm system. Furthermore, The cam of this keyswitch also serves to secure the alarm enclosure to the article to which the alarm system is attached. This is achieved with a mounting bracket which attaches around or to the supporting structure to which the alarm is to be attached; said bracket being secured when the cam of the keyswitch is used to lock the rear cover to the enclosures; this rear cover secures the mounting bracket to the article to which the alarm system is attached.

DETAILED DESCRIPTION

The alarm system disclosed is directed to an apparatus which is self contained and securely attached to the monitored article. Furthermore, the disclosed alarm system may be user programmable or pre-programmed or both and contains one or more non-position-sensitive device(s) that are activated by any motion which causes vibration to the system.

Figure 1:
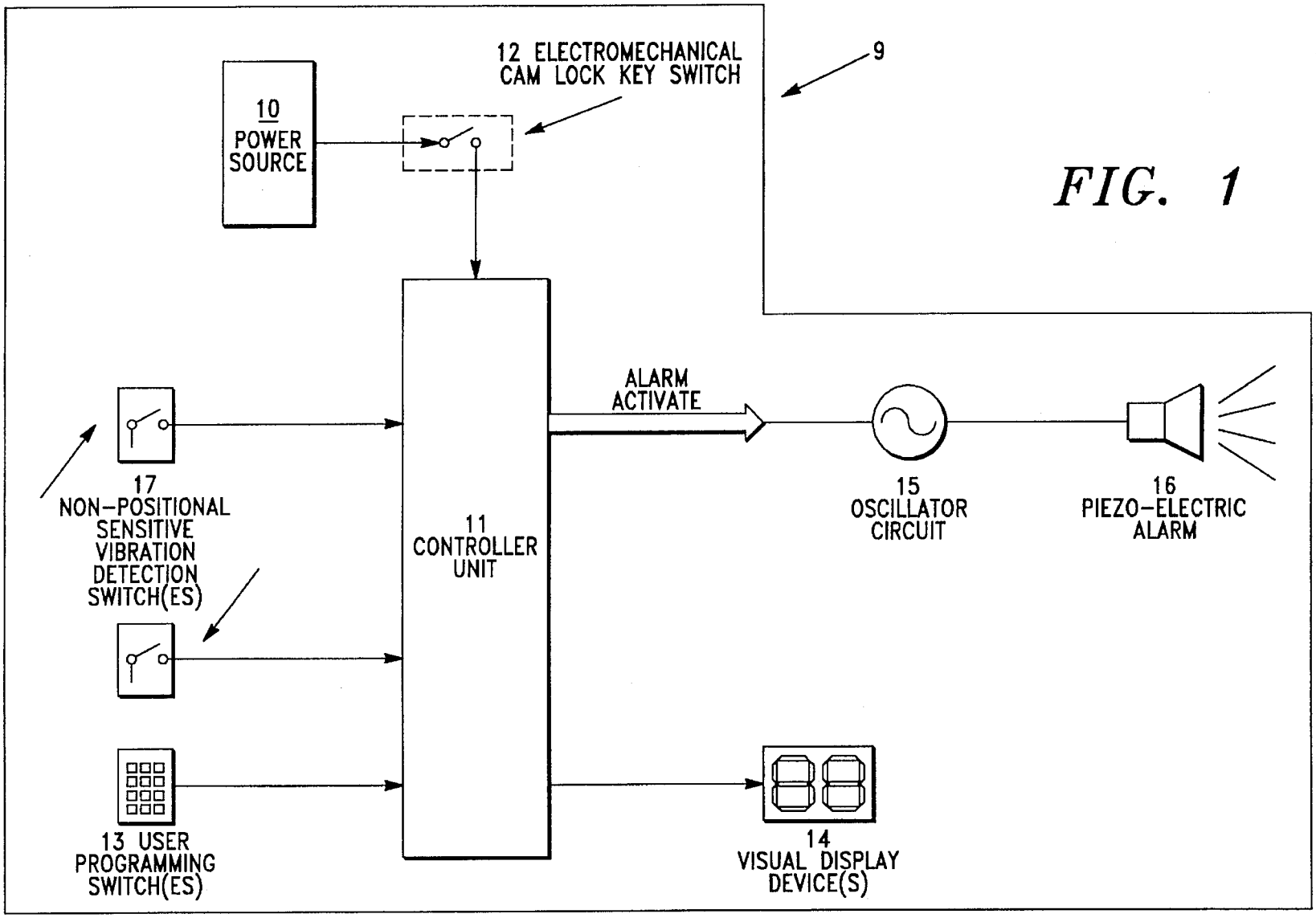
FIG. 1: A block diagram of a preferred embodiment of the alarm system incorporating the principles of the present disclosure.

FIG. 1 shows a block diagram of an embodiment of the disclosed alarm system. The alarm system (9) is powered by a battery power source (10) which is electrically connected to a controller unit (11), which may be a microcontroller, through the contacts of a cam lock keyswitch (12). When the keyswitch is turned "on" power is applied to the controller unit. The controller unit will accept user entries via user programming switch(es) (13) or is pre-programmed prior to operation, or both. If the controller unit is user programmed, output data is sent to the user via a visual display device (14) or an audio output device. At various times such as during arming time, disarming time, low battery condition, preliminary alarm condition, and verified alarm condition the controller unit will turn on an oscillator circuit (15) which will generate the alarm sound for the piezo-electric alarm (16). The controller unit monitors and detects movement of the alarm system when one or more of the non-position-sensitive vibration activated devices (17) are vibrated sufficiently such that contact is made between the switch contacts of said device(s) multiple non-position sensitive vibration activated devices may be mounted with the alarm system in various planes such as x, y, and z to increase the probability of obtaining equal switch pulses whenever the motion of the alarm system is in one or more of these planes.

Figure 3A:
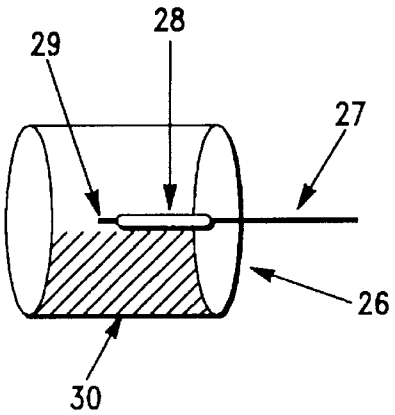
FIGS. 3A–3E: A preferred embodiment of a non-position-sensitive vibration activated device shown in several possible positional orientations.

One embodiment of a non-position-sensitive vibration activated device (17) is shown in FIGS. 3A though 3E. FIGS. 3A through 3E show the non-position-sensitive vibration activated device (17) in various positions.

The device consists of a hermetically sealed welded steel chamber (26) which has a single steel electrode pin (27) exiting through the center of one end of the device. The pin is electrically isolated from the steel chamber by a non-conductive insulator (28) which covers the entire pin inside the chamber and as the pin exits through the chamber, except for an exposed tip (29) of the pin inside the chamber.

A small ball of mercury (30) is sealed within the device such that electrical contact can be made between the tip (29) of the electrode pin and the steel chamber (26). As shown in FIGS. 3A through 3E, the device is designed with an exact quantity of mercury and in such a way as to prevent electrical contact between the tip of the electrode pin and the chamber when the device is at rest, regardless of the positional orientation of the device. Once vibrated, the mercury will roll within the chamber and make electrical contact between the tip (29) of the electrode and the chamber, which in turn allows an electrical signal to flow through the device to the controller unit.

Figure 3B:
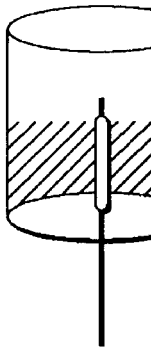
Figure 3C:
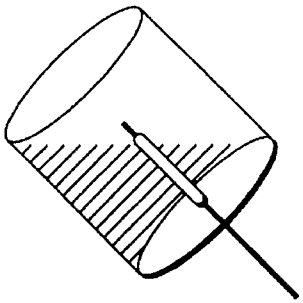
Figure 3D:
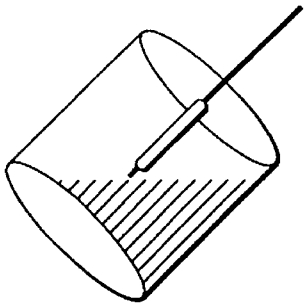
Figure 3E:
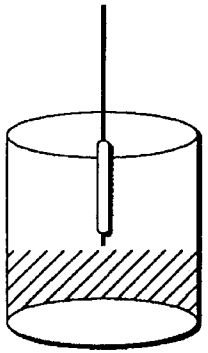

FIG. 3A shows the relationship of tip (29) and the mercury when the non-position-sensitive vibration activated device is in a horizontal position. FIG. 3B shows the relationship of tip (29) and the mercury when the non-position-sensitive vibration activated device is in a vertical position with the tip pointing upward. FIG. 3C shows the relationship of tip (29) and the mercury when the non-position-sensitive vibration activated device is in a 45° position with the tip pointing upward. FIG. 3D shows the relationship of tip (29) and the mercury when the non-position-sensitive vibration activated device is in a 45° position with the tip pointing downward. FIG. 3E shows the relationship of tip (29) and the mercury when the non-position-sensitive vibration activated device is in a vertical position with the tip pointing downward.

Figure 2:
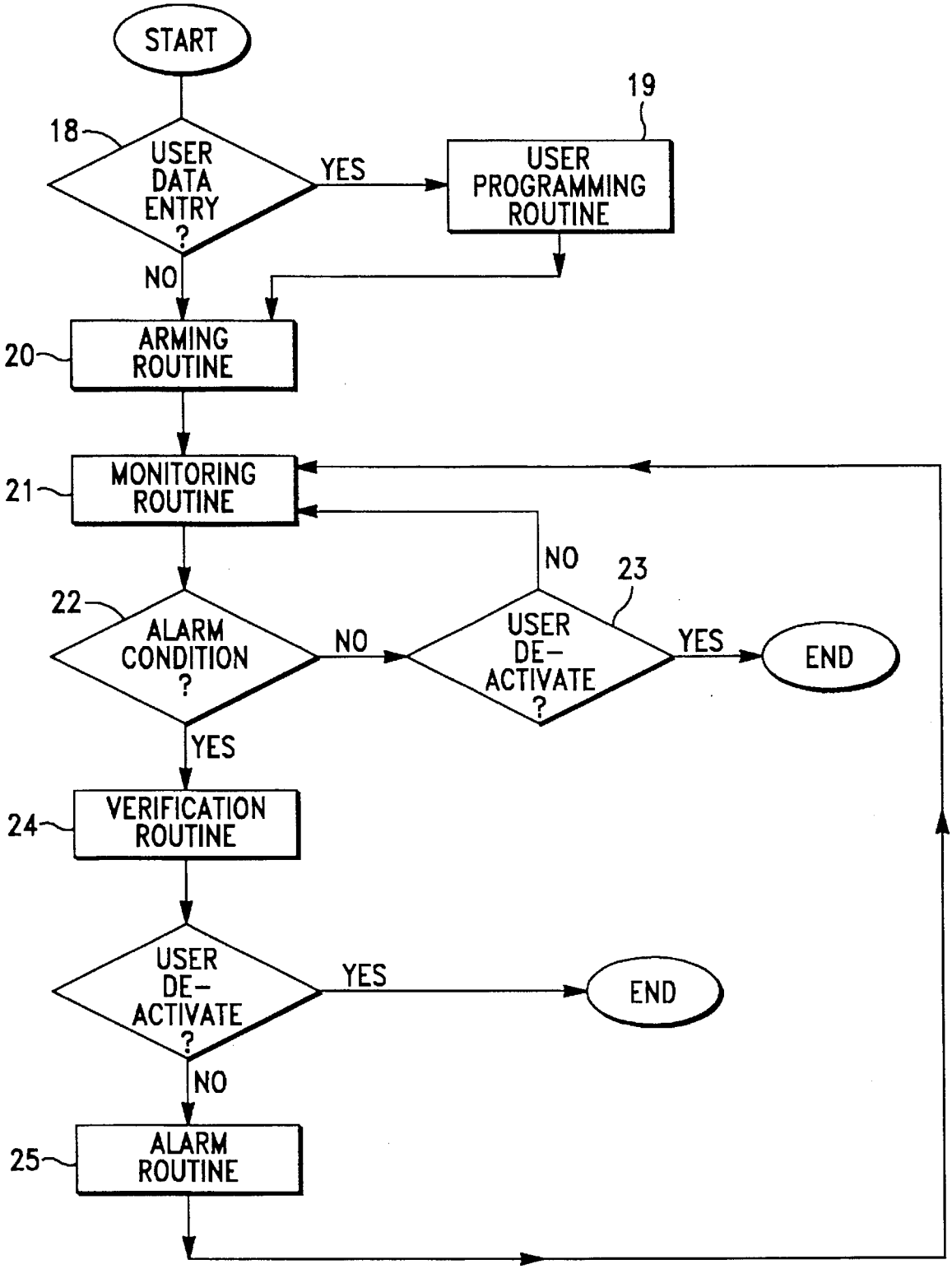
FIG. 2: A flow chart for a preferred embodiment of an operating program for the controller unit.

The controller unit runs the operating program for the alarm system. A flow chart for one version of this program is shown in FIG. 2. After power is applied to the controller unit, the user may enter programming information with a number of user programming switch(es) (18), in which case the controller will perform a user programming routine (19) which will store information for various methods of operation and operational characteristics of the alarm system. The controller unit may also be pre-programmed with the methods of operation and operational characteristics of the alarm system.

During user programming, the controller unit, in addition to receiving programming information from user programming switch(es), would interface with the user thorough the use of the visual display device(s) or an audio device. The user entry may allow user definition of such items as arming and disarming time, alarm time, types of alarm sounds under various conditions and the number of vibrations within a given period of time to create an alarm condition. Also, this user data entry may serve to change the sequence or method of operation of the alarm system.

Whether pre-programmed or user programmed, the controller unit will perform an arming routine (20) which will allow the user to arm and stabilize the alarm system without generating an alarm condition. Next, the controller unit will perform a monitoring routine (21) in which vibrations detected by the non-position-sensitive vibration activated device(s) are monitored by the controller and analyzed against the user programmed or pre-programmed alarm condition criteria (22). If no alarm condition is found, the monitoring will continue unless the user deactivates the alarm system (23). If an alarm condition is found, the controller unit will perform a verification routine (24) which would determine if the alarm condition was caused by the user or if movement of the alarm system was unauthorized. If the user does not deactivate the alarm system, the controller unit would perform the functions of an alarm routine (25). After performing the alarm routine, the controller would loop back and begin the monitoring routine (21) again.

Routines (18)–(25) are pre-programmed as the operating program for the controller unit. Variables within each routine and the sequence or method of performing each routine are either user programmable or are pre-programmed or both.

Figure 4B:
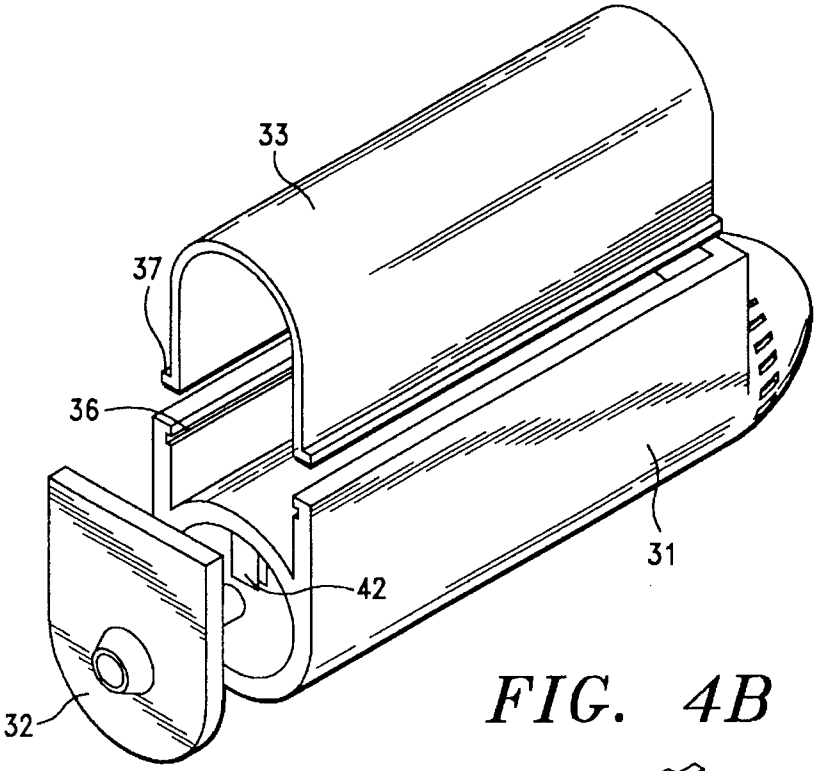
FIG. 4B: An exploded view of the enclosure of FIG. 4A.
Figure 4D:
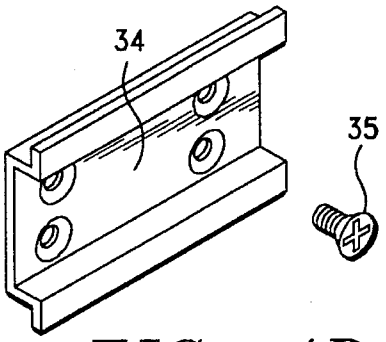
FIG. 4D: A view of an alternate mounting bracket for the alarm device.
Figure 4C:
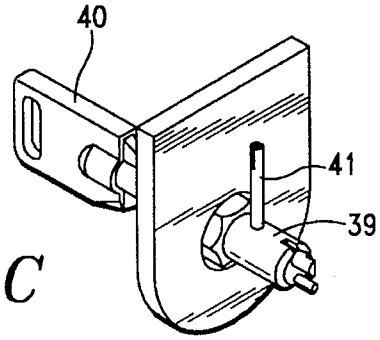
FIG. 4C: A view of the camlock keyswitch used on the alarm system.
Figure 4A:
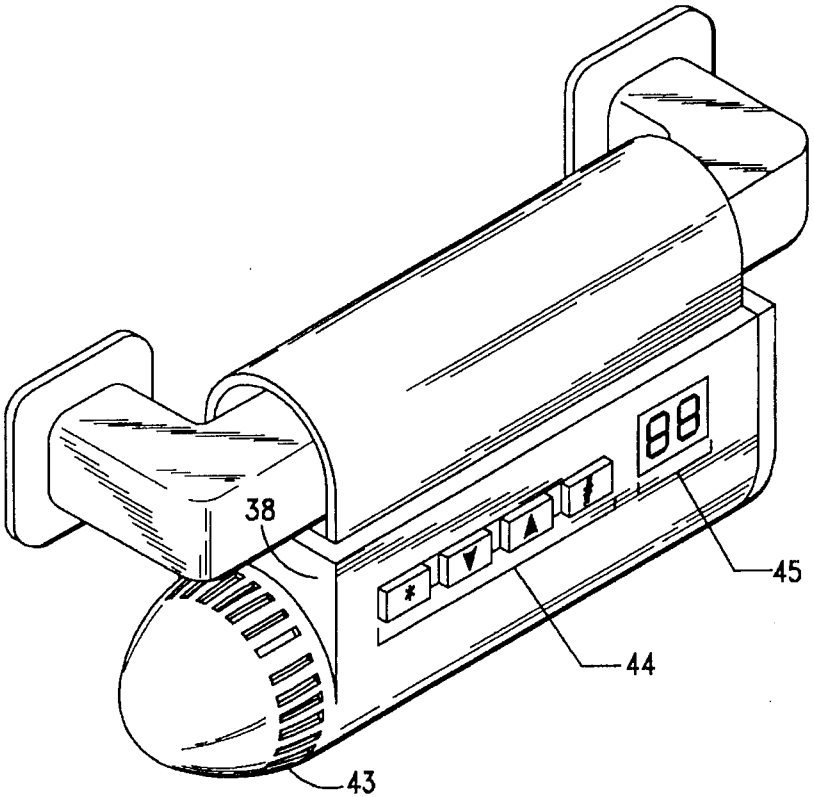
FIG. 4A: A view of one embodiment of an enclosure for the alarm system shown attached to a handle.

To ensure full effectiveness, the disclosed alarm system and it's power source are placed in an enclosure which is water resistant or waterproof and securely attached to the monitored article. One embodiment of an enclosure for the alarm system is shown in FIGS. 4A through 4D. FIGS. 4A and 4B show two views of the overall alarm system enclosure. The enclosure consists of a main housing (31), a rear cover (32), a mounting bracket for mounting the alarm to a monitored article containing a cylindrical element (33), or mounting to a flat surface (34) on the monitored article by using mounting screws (35) to secure the bracket to the article. A main housing contains slotted channels (36) which run on either side of the housing, and are closed on the end of the housing (38) furthest from the rear cover (32). Cooperating tabs (37) run along the sides of the mounting bracket and allow the bracket to attach to the monitored article while also sliding into the channels on the main housing of the alarm system enclosure. Shims may optionally be used with bracket (33) for mounting to various diameter elements. Once the bracket is slid in place, the rear cover (32) closes over the main housing. The rear cover, as shown in FIG. 4C, is locked in place by using the correct keyswitch key (40) in the cam lock key-switch (39), and turning it such that the cam of the key-switch (41) latches on a catch (42) inside the main housing. The rear cover is removed in a reverse fashion to allow user access to replace the battery power source.

Thus, the electromechanical cam lock keyswitch has multiple key position which allows its use as an electrical switch with contacts (46), a mechanical lock means for a battery compartment within the housing and indirectly as a means for securing the mounting bracket and housing, to the monitored article.

Small holes (43) are located in a plurality of locations throughout the surfaces of the main housing to allow exit of the sound from the alarm device and/or an audio output device. To ensure full dispersion of all alarm sounds the holes may also be included in areas partially covered by the mounting brackets and in other locations throughout the housing.

It is understood that the above-described embodiment is merely illustrative of the possible specific embodiments which may represent principles of the present invention. Other arrangements may readily be devised in accordance with these principles by those skilled in the art without departing from the scope of the invention.

I claim:

1. A vibration detecting alarm system adapted to be attached to an article for sounding an alarm signal, said alarm system comprising:

a tamper proof housing;

a tamper proof attaching member mounted on said housing and adapted to attach said housing to said article;

an alarm signaling device;

a power source;

a tamper-proof storage compartment for storing said power source;

one or more non-position-sensitive vibration detecting device(s) mounted in one or more preselected positions within said housing and being electrically connected to a programmable alarm system controller, each of said vibration detecting device(s) being operable, in response to movement of said article, between a first condition and a second condition whereby said alarm signaling device is activated;

a tamper-proof on/off switch means;

wherein said programmable alarm system controller is mounted within said housing and is electrically connected to said power source by said on/off switch means;

wherein said programmable controller detects movement of said article by sensing transitions between said first and second conditions of said vibration detecting devices(s);

wherein said controller contains an operating program which determines an operation of said alarm system;

wherein said operation of said alarm system begins when said on/off switch means electrically connects said power source to said controller and said controller initializes and performs instruction routines of said operating program;

wherein said operating program includes a plurality of said instruction routines, each of which can be executed and varied, executed and not varied or not executed, and the group of which can be selected to be specifically sequenced by preprogramming, user programming or a combination of preprogramming and user programming;

wherein said operating program contains variable parameters within some or all of said plurality of routines, said variable parameters being preprogrammed, user programmed or a combination of preprogrammed and user programmed;

wherein said execution of said routines and said sequencing determine a selected method of operation of said alarm system; and wherein said variable parameters within said routines determine selected characteristics of operation of said alarm system.

2. An alarm system as in claim 1 wherein said housing is made of high impact water resistant material which totally encloses said alarm system.

3. An alarm system as in claim 1, wherein said programmable controller is a microcontroller.

4. An alarm system as in claim 1, wherein said tamper proof housing, tamper proof attaching member, and tamper proof storage compartment for storing said power source includes said tamper proof on/off switch means arranged in cooperation with said housing to prevent unauthorized removal of said alarm system from said article to which said alarm system is attached and prevent unauthorized removal of said power source from said storage compartment.

5. An alarm system as in claim 1, wherein said power source is a battery.

6. An alarm system as in claim 1, wherein said one or more non-position-sensitive vibration detecting device(s) are mercury switch(es).

7. An alarm system as in claim 1, wherein said alarm signaling device is a piezo-electric alarm device.

8. An alarm system as in claim 1 wherein said routines are selected from the group including:

an instant arming routine whereby said alarm system becomes armed immediately after said alarm system activation, such that said alarm system controller begins monitoring of said first and second condition of said vibration detecting device(s); and wherein said instant arming routine may include or be followed by an instruction(s) which select(s) among variable methods by which alarm system user is notified that said alarm system is armed;

a standard arming routine whereby said alarm system becomes armed after said alarm system activation, said arming to be delayed by a variable exit delay time;

wherein said standard arming routine may include or be followed by an instruction(s) which determine(s) said variable exit delay time;

wherein said standard arming routine may include or be followed by an instruction(s) which select(s) among variable methods by which alarm system user is notified that said alarm system is being armed; and wherein said standard arming routine may include or be followed by an instruction(s) which select(s) among variable methods by which said alarm system user is notified that said alarm system is armed;

an automatic arming routine whereby said alarm system becomes armed after said alarm system activation, said arming to comprise said alarm system controller's monitoring said first and second condition of said vibration detecting device(s) and determining that said alarm system is in a proper state to be armed;

wherein said automatic arming routine may include or be followed by an instruction(s) which determine(s) said proper state by defining quantity of vibrations wherein said automatic arming routine may include or be followed by an instruction(s) which select(s) among variable methods by which said alarm system user is notified that said alarm system controller is monitoring said vibration activated device(s);

wherein said automatic arming routine may include or be followed by an instruction(s) which select(s) among variable definitions of said proper state comprised of a quantity of vibrations within a variable period of time, said period of time being either a continuous period or a sequence of a plurality of segments of time;

wherein said automatic arming routine may include or be followed by an instruction(s) which determine(s) said proper state by defining said continuous period or said sequence of a plurality of segments of time; and wherein said automatic arming routine may include or sequentially be followed by an instruction(s) which select(s) among variable methods by which alarm system user is notified that said alarm system is armed;

a special automatic arming routine whereby said alarm system becomes armed after said alarm system activation, said arming to comprise said alarm system controller's monitoring said first and second conditions of said vibration detecting device(s) over a variable continuous period of time or a sequence of a plurality of variable segments of time, and storing said conditions in memory locations within said controller, said controller being programmed to arm said alarm system and ignore said stored conditions;

wherein said special automatic arming routine may include or be followed by an instruction(s) which includes definitions of said variable continuous period of time or a sequence of a plurality of variable segments of time;

wherein said special automatic arming routine may include or be followed by an instruction(s) which determine(s) said proper state by defining said continuous period or said sequence of a plurality of segments of time;

wherein said special automatic arming routine may include or be followed by an instruction(s) which select(s) among variable methods by which said alarm system user is notified that said alarm system controller is monitoring said vibration activated device(s); and wherein said special automatic arming routine may include or be followed by an instruction(s) which select(s) among variable methods by which alarm system user is notified that said alarm system is armed;

a delay routine whereby said alarm system controller delays execution of all or part of a current or forthcoming instruction, said delay routine containing a timing variable;

a programming routine whereby said alarm system controller will accept user entry of variables used in all or some of said instruction routines; and wherein said programming routine may include or be followed by a user prompting routine;

an operating method routine whereby said routines of said operating program can be selected to be executed and varied, executed and not varied, or not executed, and the group of which can be selected to be specifically sequenced;

wherein said operating method routine may include or be followed by instruction(s) which select among variable methods by which the alarm system user is notified that said routines are selected to be executed and varied;

wherein said operating method routine may include or be followed by instruction(s) which select among variable methods by which the alarm system user is notified that said routines are selected to be executed and not varied;

wherein said operating method routine may include or be followed by instruction(s) which select among variable methods by which the alarm system user is notified that said routines are selected to be not executed;

wherein said operating method routine may include or be followed by instruction(s) which select among variable methods by which the alarm system user is notified that said routines are selected to be specifically sequenced; and wherein said operating method routine may include or be followed by instruction(s) which select among variable methods by which the alarm system user is notified of the specific sequence of said routines;

a user prompting routine whereby said alarm system controller outputs programming information to the alarm system user; and wherein said prompting routine may include or be followed by instruction(s) which select(s) among variable methods by which the alarm user is prompted with said programming information;

a standard monitoring routine whereby said alarm system controller monitors said first and second conditions of said vibration detecting device(s) against alarm condition criteria;

wherein said standard monitoring routine includes variables of quantity of vibrations detected;

wherein said standard monitoring routine may include or be followed by an instruction(s) which select(s), among variable methods by which said alarm system user is notified that said alarm condition criteria has been met; and wherein said standard monitoring routine may include or be followed by an instruction(s) which select(s) among variable methods by which alarm system user is notified that said alarm system is being monitored;

a special monitoring routine whereby said alarm system controller monitors said first and second conditions of said vibration detecting device(s) against alarm condition criteria;

wherein said special monitoring routine includes variables of quantity of vibrations detected within a variable continuous period of time or a sequence of a plurality of variable segments of time;

wherein said special monitoring routine may include or be followed by an instruction(s) which determine(s) said alarm condition criteria by defining said quantity of vibrations;

wherein said special monitoring routine may include or be followed by an instruction(s) which determine(s) said alarm condition criteria by defining said continuous period or said sequence of a plurality of segments of time;

wherein said special monitoring routine may include or be followed by an instruction(s) which select(s) among variable methods by which said alarm system user is notified that said alarm condition criteria has been met; and wherein said special monitoring routine may include or be followed by an instruction(s) which select(s) among variable methods by which alarm system user is notified that said alarm system is being monitored;

a special limits routine whereby said alarm system controller follows priority instruction(s) which set limits on one or more variables within said operating program; and wherein said special limits routine may include or be followed by instruction(s) which determine(s) said limiting variable(s);

an alarm condition routine whereby said alarm system controller outputs alarm signals to said alarm signaling device; and wherein said alarm condition routine may include or be followed by variables which include minimum alarm signaling time and maximum alarm signaling time;

an alarm sound characteristics routine whereby said alarm system controller outputs to said alarm signaling device alarm signals which contain alarm sound characteristics;

wherein said alarm sound characteristics routine may include or be followed by instruction(s) which select(s) among variable methods of alarm signaling; and wherein said variable methods of signaling may include frequency of alarm signal oscillation, intensity of said oscillation, continuous period of time of said oscillation or sequence of a plurality of segments of time of said oscillation;

an instant disarming routine whereby said alarm system becomes disarmed by alarm system deactivation;

a standard disarming routine whereby said alarm system becomes disarmed after said alarm system deactivation, said disarming to be delayed by a variable delay time;

wherein said standard disarming routine may include or be followed by an instruction(s) which determine(s) said delay time; and wherein said special disarming routine may include or be followed by an instruction(s) which select(s) among variable methods by which alarm system user is notified that said alarm system is disarmed;

a special disarming routine whereby said alarm system becomes disarmed after said alarm system deactivation, said disarming to be delayed by a variable delay time;

wherein said special disarming routine may include or be followed by an instruction(s) which determine(s) said delay time;

wherein said special disarming routine may include or be followed by an instruction(s) which select(s) among variable methods: by which alarm system user is notified that said alarm system is being disarmed wherein said special disarming routine may include or be followed by an instruction(s) which select(s) among variable methods by which alarm system user is notified that said alarm system is disarmed; and a user notification routine whereby said alarm system controller outputs notification information to the alarm system user; and wherein said notification routine may include or be followed by instruction(s) which select(s) among variable methods by which the alarm user is notified.

9. An alarm system as in claim 1 wherein said variable parameters are selected from the group including:

duration of time, and frequency of repetition of motion or no motion of said article;

duration of time, and frequency of repetition of signaling of said alarm signaling device;

duration of time, and frequency of repetition of sensing of said transitions between said first and second conditions of said vibration detecting device(s);

duration of time, and frequency of repetition of output of programming indications to said visual display device;

duration of time, and frequency of repetition of output of programming indications to said audio output device;

maximum, minimum and selected duration of time of delay within said instruction routines;

maximum and minimum duration of time of signaling of said alarm signaling device;

maximum, minimum and selected loudness of said alarm signaling device;

maximum, minimum and selected loudness of said audio output device;

maximum, minimum and selected display intensity of said visual display device; and quantity of vibrations of said vibration detecting device(s).

10. An alarm system as in claim 1 wherein said controller receives electrical signals from at least two of the group including an off/switch means, one or more vibration detecting device(s) and user programming switch(es).

11. An alarm system as in claim 10, wherein said user programming switch(es) comprise a keypad.

12. An alarm system as in claim 1 wherein said controller sends electrical signals to at least one of the group including said alarm signaling device, a visual display device and an audio output device.

13. An alarm system as in claim 12, having a device for interfacing said controller with the alarm system user;

said device being said visual display device.

14. An alarm system as in claim 12, wherein said visual display device is selected from the group including lamp, light emitting diode, and liquid crystal display.

15. An alarm system as in claim 12, having a device for interfacing said controller with the alarm system user;

said device being said audio device.

16. A programmable method for detecting movement of an article and sounding an alarm signal comprising:

preventing unauthorized removal of an alarm system from said article to which said alarm system is attached;

said method employing an attaching member mounted on a housing, adapted to be attached to said article, and a keyswitch arranged in cooperation with said housing and said attaching member to provide a tamper proof method of attaching said alarm system to said article;

preventing unauthorized removal of a power source from said alarm system, wherein said method employing a storage compartment for said power source wherein access to said compartment is restricted by a keyswitch mounted in cooperation with said compartment cover;

wherein said keyswitch being tamperproof, containing a plurality of possible key combinations and requiring the correct key in order to unlock said compartment;

detecting motion of said alarm system; said method employing one or more non-position-sensitive vibration detecting device(s) mounted in one or more preselected positions within said housing and being electrically connected to a programmable alarm system controller, each of said vibration detecting device(s) being operable, in response to movement of said article, between a first condition and a second condition; and wherein said programmable controller detects movement of said article by sensing transitions between said first and second conditions of said vibration detecting device(s);

programming operation of said alarm system; said method employing an alarm system controller containing an operating program;

indicating that said article has been moved; said method employing said alarm system controller sending signals to an alarm signaling device;

electrically powering said alarm system, said method employing a power source being electrically connected through an on/off switch means to said alarm system;

providing programming indications to a user while said user is programming said alarm system; said method comprising said alarm system controller outputting signals to a visual display device or an audio output device, or a combination of a visual display device and an audio output device; and wherein said visual display device is selected from a group including lamp, light emitting diode, and liquid crystal display;

user programming of said alarm system controller; said method employing one or more user programming switches electrically connected to said alarm system controller;

varying operation of said alarm system, said method comprising varying said operating program for said alarm system controller;

wherein said operating program is comprised of a plurality of instruction routines and variable parameters within some or all of said routines;

wherein said routines are varied by each of said plurality of said instruction routines being executed and varied, executed and not varied or not executed, and the group of said routines being specifically sequenced; and wherein said variation of said routines determines the method of operation of said alarm system;

wherein said variable parameters within said routines can be varied and wherein said variable parameters determine the characteristics of operation of said alarm system; and wherein said operating program comprises a combination of the method of operation and the characteristics of operation of said alarm system.

17. A method as in claim 16 wherein said routines are selected from the group including:

an instant arming routine whereby said alarm system becomes armed immediately after said alarm system activation, such that said alarm system controller begins monitoring of said first and second condition of said vibration detecting device(s); and wherein said instant arming routine may include or be followed by an instruction(s) which select(s) among variable methods by which alarm system user is notified that said alarm system is armed;

a standard arming routine whereby said alarm system becomes armed after said alarm system activation, said arming to be delayed by a variable exit delay time;

wherein said standard arming routine may include or be followed by an instruction(s) which determine(s) said variable exit delay time;

wherein said standard arming routine may include or be followed by an instruction(s) which select(s) among variable methods by which alarm system user is notified that said alarm system is being armed; and wherein said standard arming routine may include or be followed by an instruction(s) which select(s) among variable methods by which said alarm system user is notified that said alarm system is armed;

an automatic arming routine whereby said alarm system becomes armed after said alarm system activation, said arming to comprise said alarm system controller's monitoring said first and second condition of said vibration detecting device(s) and determining that said alarm system is in a proper state to be armed;

wherein said automatic arming routine may include or be followed by an instruction(s) which determine(s) said proper state by defining quantity of vibrations;

wherein said automatic arming routine may include or be followed by an instruction(s) which select(s) among variable methods by which said alarm system user is notified that said alarm system controller is monitoring said vibration activated device(s);

wherein said automatic arming routine may include or be followed by an instruction(s) which select(s) among variable definitions of said proper state comprised of a quantity of vibrations within a variable period of time, said period of time being either a continuous period or a sequence of a plurality of segments of time;

wherein said automatic arming routine may include or be followed by an instruction(s) which determine(s) said proper state by defining said continuous period or said sequence of a plurality of segments of time; and wherein said automatic arming routine may include or sequentially be followed by an instruction(s) which select(s) among variable methods by which alarm system user is notified that said alarm system is armed;

a special automatic arming routine whereby said alarm system becomes armed after said alarm system activation, said arming to comprise said alarm system controller's monitoring said first and second conditions of said vibration detecting device(s) over a variable continuous period of time or a sequence of a plurality of variable segments of time, and storing said conditions in memory locations within said controller, said controller being programmed to arm said alarm system and ignore said stored conditions;

wherein said special automatic arming routine may include or be followed by an instruction(s) which includes definitions of said variable continuous period of time or a sequence of a plurality of variable segments of time;

wherein said special automatic arming routine may include or be followed by an instruction(s) which determine(s) said proper state by defining said continuous period or said sequence of a plurality of segments of time;

wherein said special automatic arming routine may include or be followed by an instruction(s) which select(s) among variable methods by which said alarm system user is notified that said alarm system controller is monitoring said vibration activated device(s); and wherein said special automatic arming routine may include or be followed by an instruction(s) which select(s) among variable methods by which alarm system user is notified that said alarm system is armed;

a delay routine whereby said alarm system controller delays execution of all or part of a current or forthcoming instruction, said delay routine containing a timing variable;

a programming routine whereby said alarm system controller will accept user entry of variables used in all or some of said instruction routines; and wherein said programming routine may include or be followed by a user prompting routine;

an operating method routine whereby said routines of said operating program can be selected to be executed and varied, executed and not varied, or not executed, and the group of which can be selected to be specifically sequenced;

wherein said operating method routine may include or be followed by instruction(s) which select among variable methods by which the alarm system user is notified that said routines are selected to be executed and varied;

wherein said operating method routine may include or be followed by instruction(s) which select among variable methods by which the alarm system user is notified that said routines are selected to be executed and not varied;

wherein said operating method routine may include or be followed by instruction(s) which select among variable methods by which the alarm system user is notified that said routines are selected to be not executed;

wherein said operating method routine may include or be followed by instruction(s) which select among variable methods by which the alarm system user is notified that said routines are selected to be specifically sequenced; and wherein said operating method routine may include or be followed by instruction(s) which select among variable methods by which the alarm system user is notified of the specific sequence of said routines;

a user prompting routine whereby said alarm system controller outputs programming information to the alarm system user; and wherein said prompting routine may include or be followed by instruction(s) which select(s) among variable methods by which the alarm user is prompted with said programming information;

a standard monitoring routine whereby said alarm system controller monitors said first and second conditions of said vibration detecting device(s) against alarm condition criteria;

wherein said standard monitoring routine includes variables of quantity of vibrations detected;

wherein said standard monitoring routine may include or be followed by an instruction(s) which select(s) among variable methods by which said alarm system user is notified that said alarm condition criteria has been met; and wherein said standard monitoring routine may include or be followed by an instruction(s) which select(s) among variable methods by which alarm system user is notified that said alarm system is being monitored;

a special monitoring routine whereby said alarm system controller monitors said first and second conditions of said vibration detecting device(s) against alarm condition criteria;

wherein said special monitoring routine includes variables of quantity of vibrations detected within a variable continuous period of time or a sequence of a plurality of variable segments of time;

wherein said special monitoring routine may include or be followed by an instruction(s) which determine(s) said alarm condition criteria by defining said quantity of vibrations;

wherein said special monitoring routine may include or be followed by an instruction(s) which determine(s) said alarm condition criteria by defining said continuous period or said sequence of a plurality of segments of time;

wherein said special monitoring routine may include or be followed by an instruction(s) which select(s) among variable methods by which said alarm system user is notified that said alarm condition criteria has been met; and wherein said special monitoring routine may include or be followed by an instruction(s) which select(s) among variable methods by which alarm system user is notified that said alarm system is being monitored;

a special limits routine whereby said alarm system controller follows priority instruction(s) which set limits on one or more variables within said operating program; and wherein said special limits routine may include or be followed by instruction(s) which determine(s) said limiting variable(s);

an alarm condition routine whereby said alarm system controller outputs alarm signals to said alarm signaling device; and wherein said alarm condition routine may include or be followed by variables which include minimum alarm signaling time and maximum alarm signaling time;

an alarm sound characteristics routine whereby said alarm system controller outputs to said alarm signaling device alarm signals which contain alarm sound characteristics;

wherein said alarm sound characteristics routine may include or be followed by instruction(s) which select(s) among variable methods of alarm signaling; and wherein said variable methods of signaling may include frequency of alarm signal oscillation, intensity of said oscillation, continuous period of time of said oscillation or sequence of a plurality of segments of time of said oscillation;

an instant disarming routine whereby said alarm system becomes disarmed by alarm system deactivation;

a standard disarming routine whereby said alarm system becomes disarmed after said alarm system deactivation, said disarming to be delayed by a variable delay time;

wherein said standard disarming routine may include or be followed by an instruction(s) which determine(s) said delay time; and wherein said special disarming routine may include or be followed by an instruction(s) which select(s) among variable methods by which alarm system user is notified that said alarm system is disarmed;

a special disarming routine whereby said alarm system becomes disarmed after said alarm system deactivation, said disarming to be delayed by a variable delay time;

wherein said special disarming routine may include or be followed by an instruction(s) which determine(s) said delay time;

wherein said special disarming routine may include or be followed by an instruction(s) which select(s) among variable methods by which alarm system user is notified that said alarm system is being disarmed;

wherein said special disarming routine may include or be followed by an instruction(s) which select(s) among variable methods by which alarm system user is notified that said alarm system is disarmed; and a user notification routine whereby said alarm system controller outputs notification information to the alarm system user; and wherein said notification routine may include or be followed by instruction(s) which select(s) among variable methods by which the alarm user is notified.

18. A method as in claim 16 wherein said variable parameters are selected from the group including: duration of time, and frequency of repetition of motion or no motion of said article;

duration of time, and frequency of repetition of signaling of said alarm signaling device;

duration of time, and frequency of repetition of sensing of said transitions between said first and second conditions of said vibration detecting device(s);

duration of time, and frequency of repetition of output of programming indications to said visual display device;

duration of time, and frequency of repetition of output of programming indications to said audio output device;

maximum, minimum and selected duration of time of delay within said instruction routines;

maximum and minimum duration of time of signaling of said alarm signaling device.

maximum, minimum and selected loudness of said alarm signaling device;

maximum, minimum and selected loudness of said audio output device;

maximum, minimum and selected display intensity of said visual display device; and quantity of vibrations of said vibration detecting device(s).

19. A self-contained, programmable, non-position-sensitive, vibration detecting alarm system adapted to be attached to an article for sounding an alarm signal comprising:

an alarm signaling device;

an on/off switch means;

a power source;

one or more non-position-sensitive vibration detecting device(s) mounted in one or more preselected positions, and being electrically connected to an alarm system controller, each of said vibration detecting devices being operable, in response to movement of said alarm system, between a first condition and a second condition whereby said alarm signaling device is activated;

wherein said alarm system controller is a microcontroller;

wherein said microcontroller detects movement of an article by sensing transitions between said first condition and second condition of said vibration detecting device(s);

wherein said microcontroller contains an operating program which determines the operation of said alarm system;

wherein said microcontroller receives electrical signals from said off/switch means, said vibration detecting device(s) and optional user programming switch(es);

wherein said microcontroller sends electrical signals to said alarm signaling device, an optional visual display device and an optional audio output device;

wherein said operation of said alarm system begins when said on/off switch means electrically connects said power source to said microcontroller and said microcontroller then initializes and performs instruction routines of said operating program;

wherein said operating program includes a plurality of said instruction routines, each of which can be executed and varied, executed and not varied or not executed, and the group of which can be selected to be specifically sequenced by either preprogramming, user programming or a combination of preprogramming and user programming;

wherein said operating program contains variable parameters within some or all of said plurality of routines, said variable parameters being either preprogrammed or user programmed or a combination of preprogrammed and user programmed;

wherein said routines and said sequencing determines a selected method of operation of said alarm system;

wherein said variable parameters within said routines determine a selected characteristic of operation of said alarm system;

wherein said routines are selected from the group including:

an instant arming routine whereby said alarm system becomes armed immediately after said alarm system activation, such that said alarm system controller begins monitoring of said first and second condition of said vibration detecting device(s); and wherein said instant arming routine may include or be followed by an instruction(s) which select(s) among variable methods by which alarm system user is notified that said alarm system is armed;

a standard arming routine whereby said alarm system becomes armed after said alarm system activation, said arming to be delayed by a variable exit delay time;

wherein said standard arming routine may include or be followed by an instruction(s) which determine(s) said variable exit delay time;

wherein said standard arming routine may include or be followed by an instruction(s) which select(s) among variable methods by which alarm system user is notified that said alarm system is being armed; and wherein said standard arming routine may include or be followed by an instruction(s) which select(s) among variable methods by which said alarm system user is notified that said alarm system is armed;

an automatic arming routine whereby said alarm system becomes armed after said alarm system activation, said arming to comprise said alarm system controller's monitoring said first and second condition of said vibration detecting device(s) and determining that said alarm system is in a proper state to be armed;

wherein said automatic arming routine may include or be followed by an instruction(s) which determine(s) said proper state by defining quantity of vibrations;

wherein said automatic arming routine may include or be followed by an instruction(s) which select(s) among variable methods by which said alarm system user is notified that said alarm system controller is monitoring said vibration activated device(s);

wherein said automatic arming routine may include or be followed by an instruction(s) which select(s) among variable definitions of said proper state comprised of a quantity of vibrations within a variable period of time, said period of time being either a continuous period or a sequence of a plurality of segments of time;

wherein said automatic arming routine may include or be followed by an instruction(s) which determine(s) said proper state by defining said continuous period or said sequence of a plurality of segments of time; and wherein said automatic arming routine may include or sequentially be followed by an instruction(s) which select(s) among variable methods by which alarm system user is notified that said alarm system is armed;

a special automatic arming routine whereby said alarm system becomes armed after said alarm system activation, said arming to comprise said alarm system controller's monitoring said first and second conditions of said vibration detecting device(s) over a variable continuous period of time or a sequence of a plurality of variable segments of time, and storing said conditions in memory locations within said controller, said controller being programmed to arm said alarm system and ignore said stored conditions;

wherein said special automatic arming routine may include or be followed by an instruction(s) which includes definitions of said variable continuous period of time or a sequence of a plurality of variable segments of time;

wherein said special automatic arming routine may include or be followed by an instruction(s) which determine(s) said proper state by defining said continuous period or said sequence of a plurality of segments of time;

wherein said special automatic arming routine may include or be followed by an instruction(s) which select(s) among variable methods by which said alarm system user is notified that said alarm system controller is monitoring said vibration activated device(s); and wherein said special automatic arming routine may include or be followed by an instruction(s) which select(s) among variable methods by which alarm system user is notified that said alarm system is armed;

a delay routine whereby said alarm system controller delays execution of all or part of a current or forthcoming instruction, said delay routine containing a timing variable;

a programming routine whereby said alarm system controller will accept user entry of variables used in all or some of said instruction routines; and wherein said programming routine may include or be followed by a user prompting routine;

an operating method routine whereby said routines of said operating program can be selected to be executed and varied, executed and not varied, or not executed, and the group of which can be selected to be specifically sequenced;

wherein said operating method routine may include or be followed by instruction(s) which select among variable methods by which the alarm system user is notified that said routines are selected to be executed and varied;

wherein said operating method routine may include or be followed by instruction(s) which select among variable methods by which the alarm system user is notified that said routines are selected to be executed and not varied;

wherein said operating method routine may include or be followed by instruction(s) which select among variable methods by which the alarm system user is notified that said routines are selected to be not executed;

wherein said operating method routine may include or be followed by instruction(s) which select among variable methods by which the alarm system user is notified that said routines are selected to be specifically sequenced; and wherein said operating method routine may include or be followed by instruction(s) which select among variable methods by which the alarm system user is notified of the specific sequence of said routines;

a user prompting routine whereby said alarm system controller outputs programming information to the alarm system user; and wherein said prompting routine may include or be followed by instruction(s) which select(s) among variable methods by which the alarm user is prompted with said programming information;

a standard monitoring routine whereby said alarm system controller monitors said first and second conditions of said vibration detecting device(s) against alarm condition criteria;

wherein said standard monitoring routine includes variables of quantity of vibrations detected;

wherein said standard monitoring routine may include or be followed by an instruction(s) which select(s) among variable methods by which said alarm system user is notified that said alarm condition criteria has been met; and wherein said standard monitoring routine may include or be followed by an instruction(s) which select(s) among variable methods by which alarm system user is notified that said alarm system is being monitored;

a special monitoring routine whereby said alarm system controller monitors said first and second conditions of said vibration detecting device(s) against alarm condition criteria;

wherein said special monitoring routine includes variables of quantity of vibrations detected within a variable continuous period of time or a sequence of a plurality of variable segments of time;

wherein said special monitoring routine may include or be followed by an instruction(s) which determine(s) said alarm condition criteria by defining said quantity of vibrations;

wherein said special monitoring routine may include or be followed by an instruction(s) which determine(s) said alarm condition criteria by defining said continuous period or said sequence of a plurality of segments of time;

wherein said special monitoring routine may include or be followed by an instruction(s) which select(s) among variable methods by which said alarm system user is notified that said alarm condition criteria has been met; and wherein said special monitoring routine may include or be followed by an instruction(s) which select(s) among variable methods by which alarm system user is notified that said alarm system is being monitored;

a special limits routine whereby said alarm system controller follows priority instruction(s) which set limits on one or more variables within said operating program; and wherein said special limits routine may include or be followed by instruction(s) which determine(s) said limiting variable(s);

an alarm condition routine whereby said alarm system controller outputs alarm signals to said alarm signaling device; and wherein said alarm condition routine may include or be followed by variables which include minimum alarm signaling time and maximum alarm signaling time;

an alarm sound characteristics routine whereby said alarm system controller outputs to said alarm signaling device alarm signals which contain alarm sound characteristics;

wherein said alarm sound characteristics routine may include or be followed by instruction(s) which select(s) among variable methods of alarm signaling; and wherein said variable methods of signaling may include frequency of alarm signal oscillation, intensity of said oscillation, continuous period of time of said oscillation or sequence of a plurality of segments of time of said oscillation;

an instant disarming routine whereby said alarm system becomes disarmed by alarm system deactivation;

a standard disarming routine whereby said alarm system becomes disarmed after said alarm system deactivation, said disarming to be delayed by a variable delay time;

wherein said standard disarming routine may include or be followed by an instruction(s) which determine(s) said delay time; and wherein said special disarming routine may include or be followed by an instruction(s) which select(s) among variable methods by which alarm system user is notified that said alarm system is disarmed;

a special disarming routine whereby said alarm system becomes disarmed after said alarm system deactivation, said disarming to be delayed by a variable delay time;

wherein said special disarming routine may include or be followed by an instruction(s) which determine(s) said delay time;

wherein said special disarming routine may include or be followed by an instruction(s) which select(s) among variable methods by which alarm system user is notified that said alarm system is being disarmed;

wherein said special disarming routine may include or be followed by an instruction(s) which select(s) among variable methods by which alarm system user is notified that said alarm system is disarmed; and a user notification routine whereby said alarm system controller outputs notification information to the alarm system user; and wherein said notification routine may include or be followed by instruction(s) which select(s) among variable methods by which the alarm user is notified; and wherein said variable parameters are selected from the group including:

duration of time, and frequency of repetition of motion or no motion of said article;

duration of time, and frequency of repetition of signaling of said alarm signaling device;

duration of time, and frequency of repetition of sensing of said transitions between said first and second conditions of said vibration detecting device(s);

duration of time, and frequency of repetition of output of programming indications to said visual display device;

duration of time, and frequency of repetition of output of programming indications to said audio output device;

maximum, minimum and selected duration of time of delay within said instruction routines;

maximum and minimum duration of time of signaling of said alarm signaling device;

maximum, minimum and selected loudness of said alarm signaling device;

maximum, minimum and selected loudness of said audio output device;

maximum, minimum and selected display intensity of said visual display device; and quantity of vibrations of said vibration detecting device(s).

20. A self-contained, programmable, vibration detecting alarm system adapted to be attached to an article for detecting motion of said article and sounding an alarm signal comprising:

means for preventing unauthorized removal of said alarm system from said article, said means comprising a tamper proof housing and a tamper proof attaching member mounted on said housing and adapted to attach said housing to said article;

means for detecting movement of said article, said means comprising one or more non-position-sensitive vibration detecting device(s) mounted in one or more preselected positions within said housing and being electrically connected to a programmable alarm system controller, each of said vibration detecting device(s) being operable, in response to movement of said article, between a first condition and a second condition; and wherein said programmable controller detects movement of said article by sensing transitions between said first and second conditions of said vibration detecting device(s);

means for programing operation of said alarm system, said means comprising an alarm system controller;

means for providing an audible alarm signal upon movement of said alarm system, said means comprising an alarm signaling device;

means for electrically powering said alarm system, said means comprising a battery power source;

means for preventing unauthorized removal of said battery, said means comprising a tamper proof storage compartment;

means for connecting and disconnecting said battery from said alarm system controller; said means comprising an on/off switch;

means for providing programming indications to a user while said user is programing said alarm system, said means comprising a visual display device or said means comprising an audio output device, or said means comprising a combination of both said visual display device and said audio output device;

means for user programming of said alarm system controller, said means comprising one or more user programming switch(es);

means for varying the operation of said alarm system, said means varying the methods of operation of said alarm system or the characteristics of operation of said alarm system or a combination of the methods of operation and the characteristics of operation of said alarm system;

said varying means consisting of an operating program for said alarm system controller containing instruction routines and variable parameters within some or all of said routines;

wherein said method of operation of said alarm system consists of a plurality of said instruction routines, each of which can be executed and varied, executed and not varied, or not executed; and the group of which can be selected to be specifically sequenced;

wherein selection of said execution and sequencing of said routines provides the means for varying the method of operation of said alarm system;

wherein said characteristics of operation of said alarm system consist of variable parameters within said instruction routine(s);

wherein selection of said variable parameters provides the means for varying the characteristics of operation of said alarm system.

21. An alarm system as in claim 20 wherein said routines are selected from the group including:

an instant arming routine whereby said alarm system becomes armed immediately after said alarm system activation, such that said alarm system controller begins monitoring of said first and second condition of said vibration detecting device(s); and wherein said instant arming routine may include or be followed by an instruction(s) which select(s) among variable methods by which alarm system user is notified that said alarm system is armed;

a standard arming routine whereby said alarm system becomes armed after said alarm system activation, said arming to be delayed by a variable exit delay time;

wherein said standard arming routine may include or be followed by an instruction(s) which determine(s) said variable exit delay time;

wherein said standard arming routine may include or be followed by an instruction(s) which select(s) among variable methods by which alarm system user is notified that said alarm system is being armed; and wherein said standard arming routine may include or be followed by an instruction(s) which select(s) among variable methods by which said alarm system user is notified that said alarm system is armed;

an automatic arming routine whereby said alarm system becomes armed after said alarm system activation, said arming to comprise said alarm system controller's monitoring said first and second condition of said vibration detecting device(s) and determining that said alarm system is in a proper state to be armed;

wherein said automatic arming routine may include or be followed by an instruction(s) which determine(s) said proper state by defining quantity of vibrations wherein said automatic arming routine may include or be followed by an instruction(s) which select(s) among variable methods by which said alarm system user is notified that said alarm system controller is monitoring said vibration activated device(s);

wherein said automatic arming routine may include or be followed by an instruction(s) which select(s) among variable definitions of said proper state comprised of a quantity of vibrations within a variable period of time, said period of time being either a continuous period or a sequence of a plurality of segments of time;

wherein said automatic arming routine may include or be followed by an instruction(s) which determine(s) said proper state by defining said continuous period or said sequence of a plurality of segments of time; and wherein said automatic arming routine may include or sequentially be followed by an instruction(s) which select(s) among variable methods by which alarm system user is notified that said alarm system is armed;

a special automatic arming routine whereby said alarm system becomes armed after said alarm system activation, said arming to comprise said alarm system controller's monitoring said first and second conditions of said vibration detecting device(s) over a variable continuous period of time or a sequence of a plurality of variable segments of time, and storing said conditions in memory locations within said controller, said controller being programmed to arm said alarm system and ignore said stored conditions;

wherein said special automatic arming routine may include or be followed by an instruction(s) which includes definitions of said variable continuous period of time or a sequence of a plurality of variable segments of time;

wherein said special automatic arming routine may include or be followed by an instruction(s) which determine(s) said proper state by defining said continuous period or said sequence of a plurality of segments of time;

wherein said special automatic arming routine may include or be followed by an instruction(s) which select(s) among variable methods by which said alarm system user is notified that said alarm system controller is monitoring said vibration activated device(s); and wherein said special automatic arming routine may include or be followed by an instruction(s) which select(s) among variable methods by which alarm system user is notified that said alarm system is armed;

a delay routine whereby said alarm system controller delays execution of all or part of a current or forthcoming instruction, said delay routine containing a timing variable;

a programming routine whereby said alarm system controller will accept user entry of variables used in all or some of said instruction routines; and wherein said programming routine may include or be followed by a user prompting routine;

an operating method routine whereby said routines of said operating program can be selected to be executed and varied, executed and not varied, or not executed, and the group of which can be selected to be specifically sequenced;

wherein said operating method routine may include or be followed by instruction(s) which select among variable methods by which the alarm system user is notified that said routines are selected to be executed and varied;

wherein said operating method routine may include or be followed by instruction(s) which select among variable methods by which the alarm system user is notified that said routines are selected to be executed and not varied;

wherein said operating method routine may include or be followed by instruction(s) which select among variable methods by which the alarm system user is notified that said routines are selected to be not executed;

wherein said operating method routine may include or be followed by instruction(s) which select among variable methods by which the alarm system user is notified that said routines are selected to be specifically sequenced; and wherein said operating method routine may include or be followed by instruction(s) which select among variable methods by which the alarm system user is notified of the specific sequence of said routines;

a user prompting routine whereby said alarm system controller outputs programming information to the alarm system user; and wherein said prompting routine may include or be followed by instruction(s) which select(s) among variable methods by which the alarm user is prompted with said programming information;

a standard monitoring routine whereby said alarm system controller monitors said first and second conditions of said vibration detecting device(s) against alarm condition criteria;

wherein said standard monitoring routine includes variables of quantity of vibrations detected;

wherein said standard monitoring routine may include or be followed by an instruction(s) which select(s) among variable methods by which said alarm system user is notified that said alarm condition criteria has been met; and wherein said standard monitoring routine may include or be followed by an instruction(s) which select(s) among variable methods by which alarm system user is notified that said alarm system is being monitored;

a special monitoring routine whereby said alarm system controller monitors said first and second conditions of said vibration detecting device(s) against alarm condition criteria;

wherein said special monitoring routine includes variables of quantity of vibrations detected within a variable continuous period of time or a sequence of a plurality of variable segments of time;

wherein said special monitoring routine may include or be followed by an instruction(s) which determine(s) said alarm condition criteria by defining said quantity of vibrations;

wherein said special monitoring routine may include or be followed by an instruction(s) which determine(s) said alarm condition criteria by defining said continuous period or said sequence of a plurality of segments of time;

wherein said special monitoring routine may include or be followed by an instruction(s) which select(s) among variable methods by which said alarm system user is notified that said alarm condition criteria has been met; and wherein said special monitoring routine may include or be followed by an instruction(s) which select(s) among variable methods by which alarm system user is notified that said alarm system is being monitored;

a special limits routine whereby said alarm system controller follows priority instruction(s) which set limits on one or more variables within said operating program; and wherein said special limits routine may include or be followed by instruction(s) which determine(s) said limiting variable(s);

an alarm condition routine whereby said alarm system controller outputs alarm signals to said alarm signaling device; and wherein said alarm condition routine may include or be followed by variables which include minimum alarm signaling time and maximum alarm signaling time;

an alarm sound characteristics routine whereby said alarm system controller outputs to said alarm signaling device alarm signals which contain alarm sound characteristics;

wherein said alarm sound characteristics routine may include or be followed by instruction(s) which select(s) among variable methods of alarm signaling; and wherein said variable methods of signaling may include frequency of alarm signal oscillation, intensity of said oscillation, continuous period of time of said oscillation or sequence of a plurality of segments of time of said oscillation;

an instant disarming routine whereby said alarm system becomes disarmed by alarm system deactivation;

a standard disarming routine whereby said alarm system becomes disarmed after said alarm system deactivation, said disarming to be delayed by a variable delay time;

wherein said standard disarming routine may include or be followed by an instruction(s) which determine(s) said delay time; and wherein said special disarming routine may include or be followed by an instruction(s) which select(s) among variable methods by which alarm system user is notified that said alarm system is disarmed;

a special disarming routine whereby said alarm system becomes disarmed after said alarm system deactivation, said disarming to be delayed by a variable delay time;

wherein said special disarming routine may include or be followed by an instruction(s) which determine(s) said delay time;

wherein said special disarming routine may include or be followed by an instruction(s) which select(s) among variable methods by which alarm system user is notified that said alarm system is being disarmed;

wherein said special disarming routine may include or be followed by an instruction(s) which select(s) among variable methods by which alarm system user is notified that said alarm system is disarmed; and a user notification routine whereby said alarm system controller outputs notification information to the alarm system user; and wherein said notification routine may include or be followed by instruction(s) which select(s) among variable methods by which the alarm user is notified.

22. An alarm system as in claim 20 wherein said variable parameters are selected from the group including:

duration of time, and frequency of repetition of motion or no motion of said article;

duration of time, and frequency of repetition of signaling of said alarm signaling device;

duration of time, and frequency of repetition of sensing of said transitions between said first and second conditions of said vibration detecting device(s);

duration of time, and frequency of repetition of output of programming indications to said visual display device;

duration of time, and frequency of repetition of output of programming indications to said audio output device;

maximum, minimum and selected duration of time of delay within said instruction routines;

maximum and minimum duration of time of signaling of said alarm signaling device;

maximum, minimum and selected loudness of said alarm signaling device;

maximum, minimum and selected loudness of said audio output device;

maximum, minimum and selected display intensity of said visual display device; and quantity of vibrations of said vibration detecting device(s).

* * * * *